United States Patent [19]

Schlüsener et al.

[11] Patent Number: 4,492,410

[45] Date of Patent: Jan. 8, 1985

[54] APPARATUS FOR CONTROLLING THE POSITION OF A MINERAL MINING MACHINE

[75] Inventors: Horst Schlüsener, Werne; Norbert Hesse, Lünen, both of Fed. Rep. of Germany

[73] Assignee: Gewerkschaft Eisenhutte Westfalia, Linen, Fed. Rep. of Germany

[21] Appl. No.: 373,548

[22] Filed: Apr. 30, 1982

[30] Foreign Application Priority Data

May 2, 1981 [DE] Fed. Rep. of Germany ..... 3117401

[51] Int. Cl.[3] ..... E21C 27/32

[52] U.S. Cl. ..... 299/43; 299/34

[58] Field of Search ..... 299/43, 33, 34, 31, 299/42; 405/299, 297; 403/143, 122

[56] References Cited

U.S. PATENT DOCUMENTS

| | | | |
|---|---|---|---|
| 2,288,767 | 7/1942 | Young | 403/143 |
| 3,069,210 | 12/1962 | Rogers et al. | 403/143 |
| 3,915,500 | 10/1975 | Schluserer et al. | 405/299 |
| 4,200,338 | 4/1980 | Beckmann | 299/34 |
| 4,327,946 | 5/1982 | Kirchbrucker | 299/33 |
| 4,366,989 | 1/1983 | Braun | 299/34 |
| 4,367,968 | 1/1983 | Ishida | 403/122 |
| 4,379,661 | 4/1983 | Wojaczek et al. | 405/299 |
| 4,458,951 | 7/1984 | Merten et al. | 299/43 |

*Primary Examiner*—William F. Pate, III

*Attorney, Agent, or Firm*—Sughrue, Mion, Zinn, Macpeak, and Seas

[57] ABSTRACT

Apparatus for controlling the position of a mineral mining machine, such as a plow, guided for movement along a guide, employs inclined piston and cylinder units connected between connectors at the ends of elongate beams or rods guided on support units and brackets on a conveyor supporting the guide. The units have cylinders coupled via ball-and-socket joints to the brackets and these joints are disposed above pivot joints linking the conveyor to the connectors. The piston rods of the units are received in pockets in the connectors and flexibly and pivotably coupled thereto.

15 Claims, 7 Drawing Figures

S

APPARATUS FOR CONTROLLING THE POSITION OF A MINERAL MINING MACHINE

BACKGROUND OF THE INVENTION

The present invention relates in general to mineral mining installations and, more particularly, to apparatus for controlling or adjusting the position of a mineral mining machine movable along guide means.

U.S. Patent Specification 4045089 describes apparatus of the type with which the present invention is concerned. This apparatus takes the form of hydraulic piston and cylinder units coupled between brackets on a conveyor and connectors pivotably connected to the conveyor. Elongate beams are linked to the connectors and are guided on roof supports. Operation of the units causes the conveyor and a guide for the machine to tilt thereby to control the position of a machine, such as a plough, mounted on the guide. The units are coupled to the connectors with the aid of ball-and-socket joints which provide flexibility enabling the arrangement to cope with the prevailing conditions in the mine working. A general object of the present invention is to provide an improved form of control apparatus.

SUMMARY OF THE INVENTION

Apparatus constructed in accordance with the invention comprises one or more elongate rods or beams connected to or connectible with a support, connection means effecting pivotal connection between the rod or rods and guide means along which a machine, such as a plough is displaceable and at least one piston and cylinder unit connected between the guide means and the connection means and operable to adjust the guide means to control the position of the machine. In accordance with the invention, the piston and cylinder unit is coupled to the guide means with the aid of a ball-and-socket joint located above the pivotal connection between the guide means and the connection means and the connection means has a pocket for receiving a lower region of the piston and cylinder unit which is connected to said connection means via a lower pivot joint. Such an arrangement is particularly compact and flexible and well able to cope with the harsh conditions encountered in the mine working. Preferably the cylinder of the unit is coupled to the guide means with the ball-and-socket joint. In a preferred embodiment, part of the joint is provided on a bracket or a similar support assembly at a side of a scraper-chain conveyor remote from a mineral face of the mine working and a guide supporting the machine or plough is provided at the mineral face side of the conveyor. The piston rod of the unit would be received in the pocket and preferably a spherical bearing is provided in the pocket as the lower pivot joint to link the unit to the connection means. The latter may take the form of a single or multi-part component at least partly constituting a head piece interconnecting a pair of parallel guide rods which are slidably and pivotably guided on the support.

Normally a plurality of piston and cylinder units constructed as aforesaid would be distributed along the mine working with pairs of guide beams or rods connected to each such unit via the associated connecting means and to respective roof supports. The units adjust the angle between the guide means and the rods. The rods or beams can be resilient round bars. It is desirable to guide the rear ends of the rods remote from the connecting means, on the associated support so the rods can pivot and move longitudinally while being retained vertically, as is known per se.

By arranging the ball-and-socket joint for the unit at the upper end preferably on the cylinder thereof, minimal space is needed for the lower piston rod joint i.e. the preferred spherical bearing. This in turn enables the rod and its pivot joint to be positioned close to the pivot connection between the guide means and the connection means with the unit inclined. Moreover, the ball-and-socket joints are not prone to be disabled through the ingress of matter e.g. coal particles. The pockets or recess which receives the piston rod extends entirely through the connecting means to open towards the top and the bottom. Thus, dirt or fine coal particles can pass through the pockets and fall onto the floor. To facilitate assembly, the pocket is preferably tapered to widen out in the manner of a trumpet bell both in the upper and lower directions. This also assists in ensuring dirt and the like cannot accumulate and block the lower pivot joint of the unit.

As mentioned previously the lower pivot joint is preferably constructed as a spherical bearing to provide additional flexibility. Conveniently, a pivot pin for the lower pivot joint is located in bores in the connecting means or head piece which communicate with the pocket. A differential size between end regions of the pin ensures that the pin can be easily assembled and dismantled from one direction. The bores for the pivot pin are inclined so that the axis of the latter is maintained perpendicular to the longitudinal axis of the unit. The pin can have a a convex central region which locates with a corresponding shaped inner surface formed in a cross-bore extending through the piston rod. The cylinder of the unit can be formed with a part spherical head forming the ball component of the ball-and-socket joint. The socket component is then provided on the support bracket fitted to the conveyor side wall. Preference is given to a construction where the socket component is embodied by a number of complementary parts, conveniently castings, providing a half shell and two other parts which together make up another half-shell.

A cover plate, conveniently a resilient component such as rubber or plastics, can be flexibly supported on the connection means or the head piece to screen the guide rod or rods from the upper side. The connection means or head piece can take a variety of forms and in one construction the head piece has a trough-like profile between one region formed with the pocket and an opposite region linked to the guide rod or rods.

A mineral mining installation constructed in accordance with the invention may comprise a scraper-chain conveyor with a machine guide on one side, roof supports arranged at the opposite side of the conveyor, shifting rams operably connected between the supports and the conveyor, elongate rods guidably connected to each support, connecting means for effecting a pivotal connection between the rods and the conveyor and piston cylinder units operable to control the position of the conveyor and the guide, wherein each unit is connected via a flexible pivot joint to the conveyor and to an associated connecting means, each unit being in an inclined disposition and said flexible pivot joints include a ball-and-socket joint arranged at the upper end of said unit.

The invention may be understood more readily, and various other features of the invention may become apparent, from consideration of the following description.

BRIEF DESCRIPTION OF DRAWINGS

Embodiments of the invention will now be described, by way of examples only, with reference to the accompanying drawings wherein.

DESCRIPTION OF PREFERRED EMBODIMENTS

Figures 1, 2, 3:
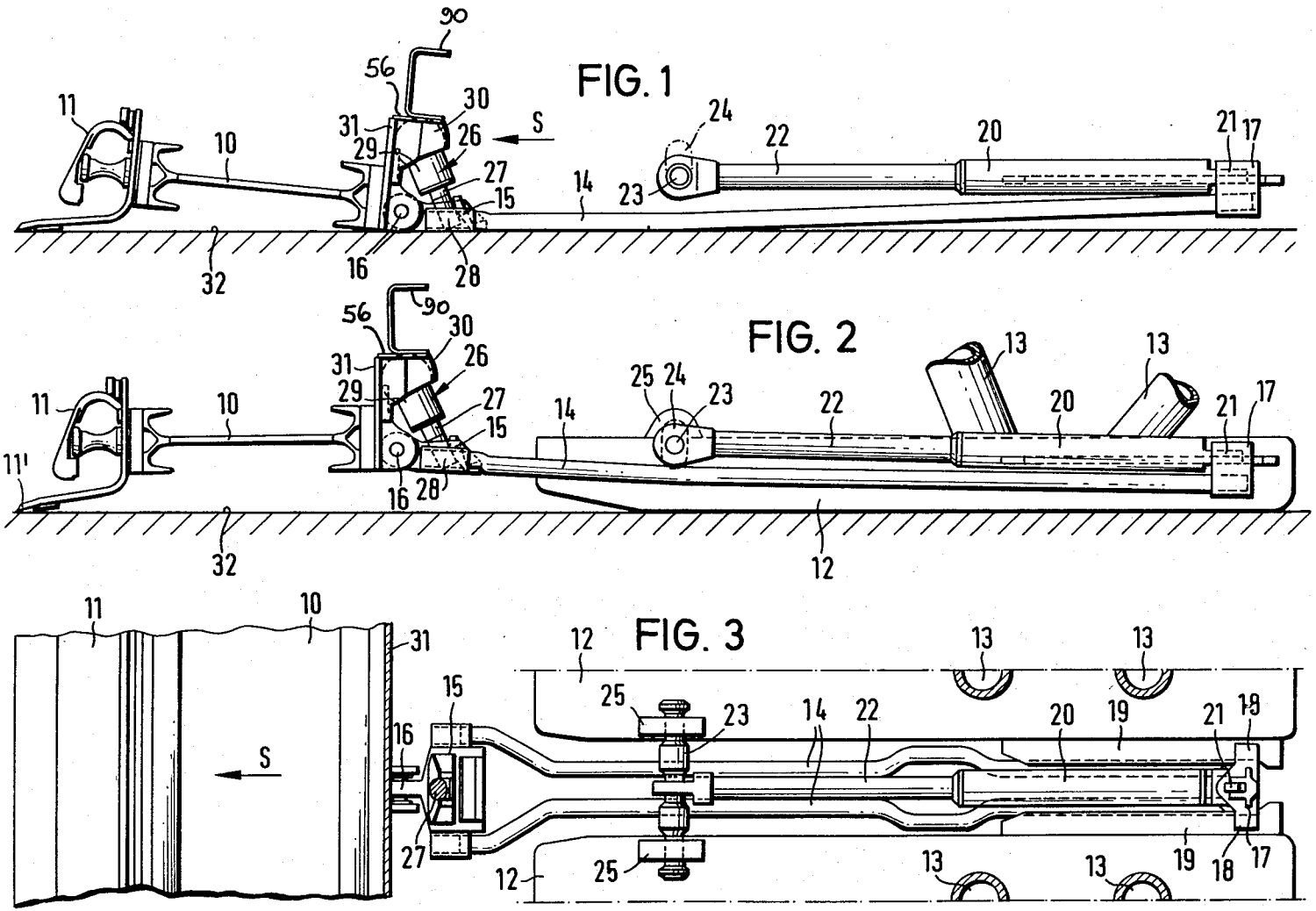
FIG. 1 is a schematic side view of part of a mineral mining installation employing apparatus constructed in accordance with the invention.
FIG. 2 is a side view of the installation generally corresponding to FIG. 1 but with the apparatus adjusted to a different operating position.
FIG. 3 is a plan view of the part of the installation and apparatus shown in FIGS. 1 and 2.

As shown in FIGS. 1 to 6, a mineral mining installation employs a scraper-chain conveyor 10 disposed alongside a mineral face. As is known the conveyor 10 is composed of a series of channel-sections or pans arranged end-to-end. On the mineral face side of the conveyor 10 there is a guide 11 on which a mineral winning machine, such as a plough (not shown) is mounted for movement back and forth alongside the mineral face. On the side of the conveyor 10 remote from the mineral face, i.e. on the stowage or goaf side, there are provided a plurality of support units which serve to support the roof of the mine working. Only the floor-engaging structure 12 of one of the supports is shown in the drawings in conjunction with the associated hydraulic props 13 conveniently linked to the structure 12 with swivel, e.g. ball-and-socket, joints.

Each support unit, is connected to the conveyor 10 with the aid of a pair of elongate parallel beams or rods 14 interconnected at their front ends by way of a connector or head piece 15. The jib-like rods 14 are generally of circular cross-section and are inherently resilient. The head piece 15 is in turn connected to the conveyor 10 by way of a pivot joint 16. The axis of pivoting of the joint 16 extends longitudinally parallel to the conveyor 10 and the guide 11. At their rear ends, the rods 14 are interconnected by way of a yoke 17 which has ends 18 slidably guided in guideways 19 formed in the floor sill structure 12 of the support unit. The arrangement is such that the guide rods 14 are guided in the direction of shifting S along the floor sill structure 12 of the associated support and at the same time the rods 14 are rendered pivotable in relation to the structure 12 by the yoke 17 which nevertheless is retained within the guide way 19. Each support also has a hydraulic shifting ram 20 disposed between the rods 14 with its cylinder connected by a pivot joint 21 to the yoke 17. The ram 20 has a piston rod 22 pivotably linked to a further cross-piece or yoke 23 which engages in vertical slots 24 of brackets 25 mounted on the floor sill structure 12. When the ram 20 is retracted, the conveyor 10 and the guide 11 are thrust forward in the direction of arrow S towards the mineral face by way of the guide rods 14 and the yoke 17 slides along the guideways 19. Conversely, when the ram 20 is extended, and the props 13 of the associated support are relieved, the entire support will be drawn up in the shifting direction S. In accordance with the invention, there is provided apparatus for adjusting the position of the guide 11 thereby to control the position of the winning machine. This apparatus takes the form of force applying means between each of the head pieces 15 and the assembly composed of the conveyor 10 and the guide 11. More particularly the apparatus comprises a series of hydraulic piston and cylinder units 26. The units 26 are arranged in inclined dispositions with the piston rods 27 of the units 26 at the underside of the units 26. The piston rods 27 are connected via pivot joints 28 to the head pieces 15 while the cylinders 29 of the units 26 are connected via ball-and-socket joints 30 to brackets or similar attachments fixed to the goaf side of the conveyor 10. As depicted, these attachments comprise side plates 31 which extend upwardly from the side wall of the conveyor and top plates 56. As shown in FIGS. 1 and 2, channels 90, can be mounted on the top plates 56 to accommodate hoses or conduits for example. The ball-and-socket joints 30 are situated above the joints 16. The joints 28 are disposed closely adjacent to the joints 16 only slightly offset therefrom. This results in a particularly compact arrangement without excessively restricting the available space between the conveyor 10 and the floor sill structures 12 of the supports.

FIG. 1 shows the guide 11 in one operating position. If the units 26 are retracted the conveyor 10 with the guide 11 will be tilted about the edge 11' of the guide 11 as shown in FIG. 2. During this adjustment the guide rods 14 swing about their rear ends where they are held captive in the longitudinal sense by the guideways 19. In the position shown in FIG. 2 the machine or plough guided on the guide 11 will tend to dip towards the floor of the working. Conversely, when the units 26 are extended the guide 11 and the conveyor 10 are tilted in the opposite direction and the machine or plough will tend to climb.

Figure 4:
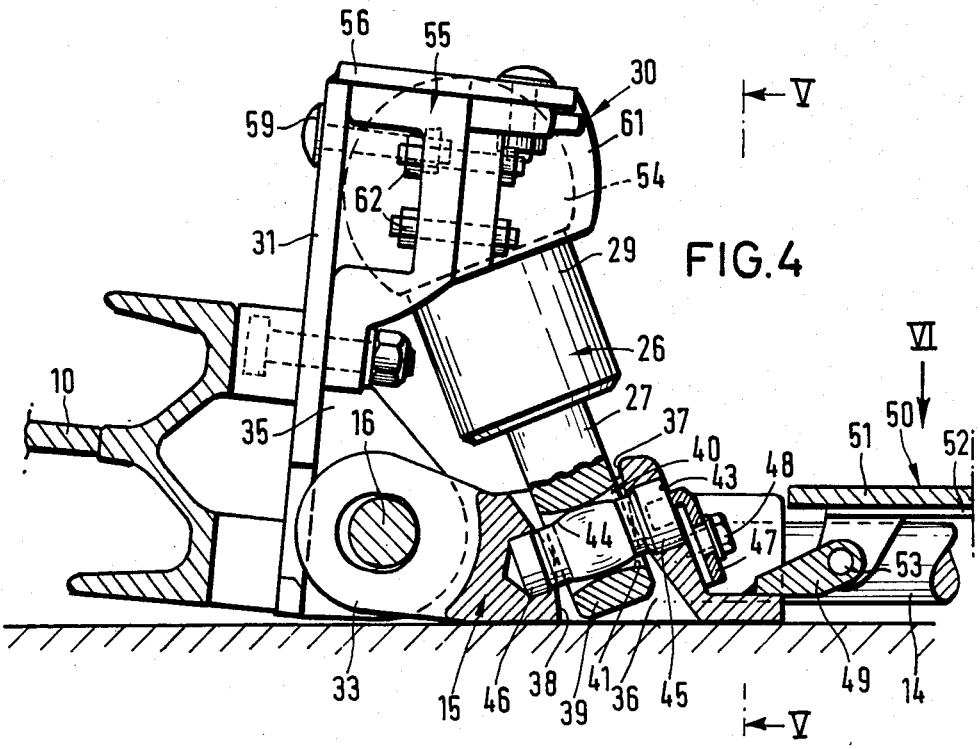
FIG. 4 is a schematic part-sectional side view of the apparatus of FIGS. 1 to 3 taken on a somewhat larger scale.
Figure 5:
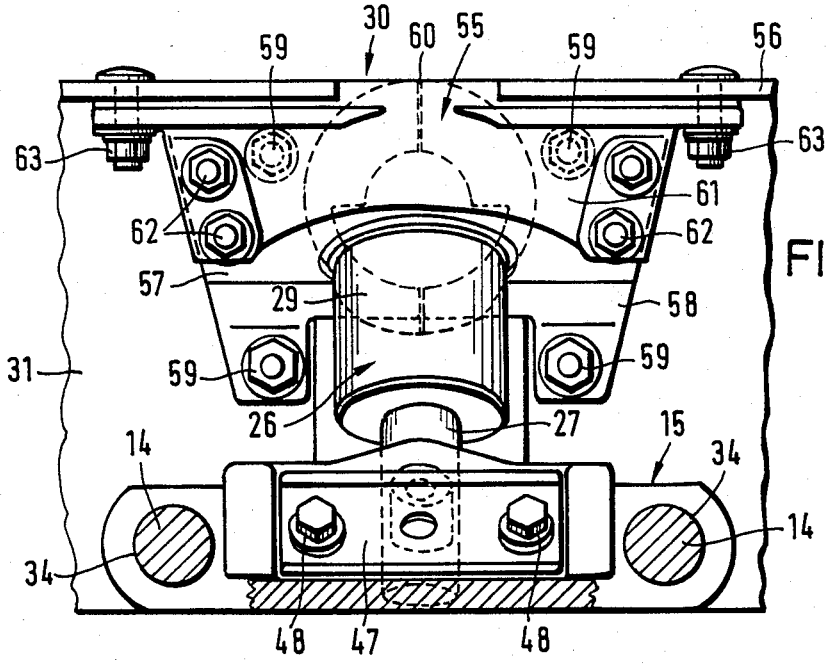
FIG. 5 is a sectional front view of the apparatus taken on the line 5—5 of FIG. 4.
Figure 6:
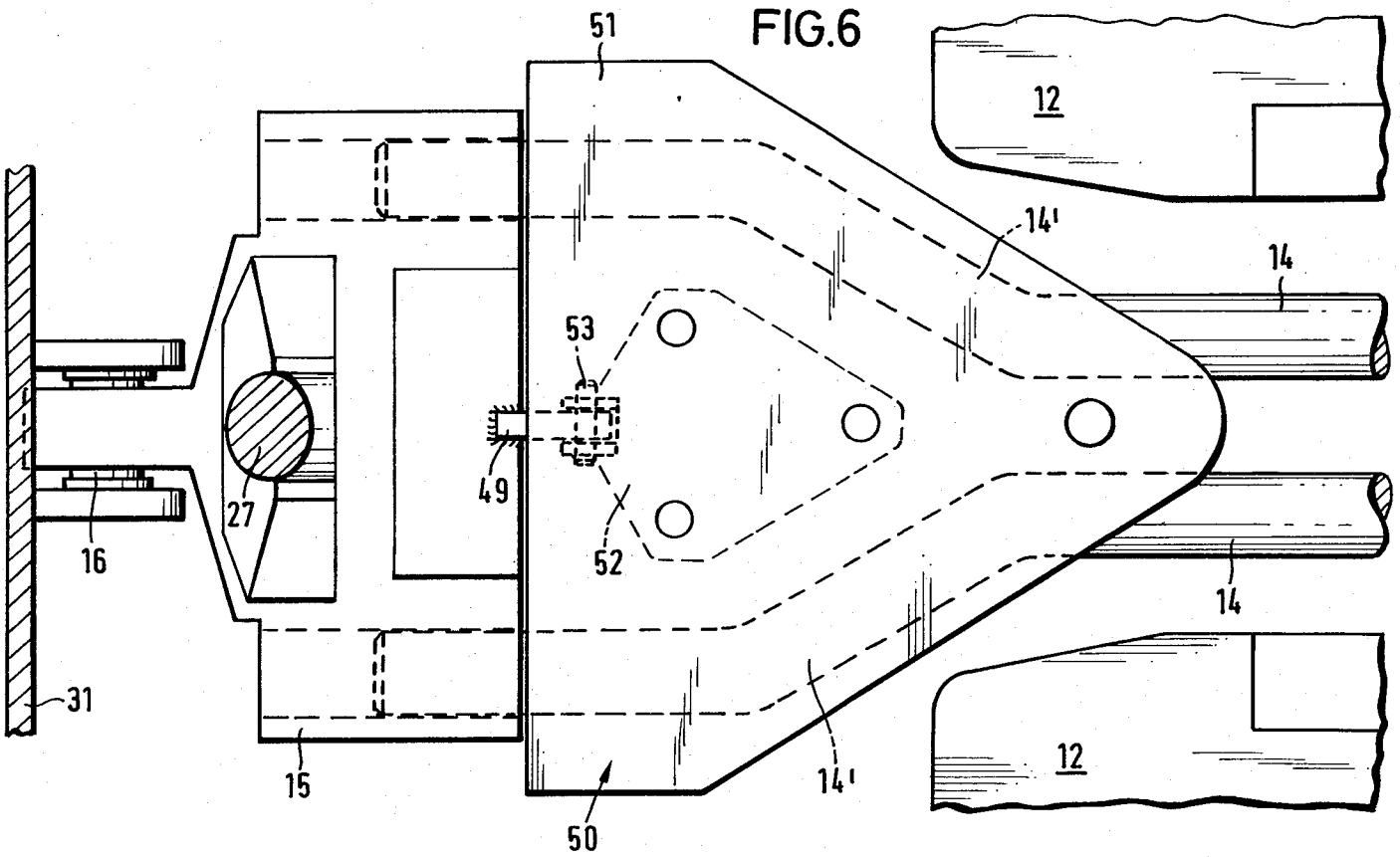
FIG. 6 is a plan view of the apparatus taken in the direction of arrow 6 in FIG. 4.

FIGS. 4 and 5 depict the preferred arrangement for one of the units 26 of the apparatus and the associated connecting means or head piece 15 which interconnect the associated guide rods 14. As shown in FIG. 5 the head piece is provided with a pair of lateral projections forming mounting devices for the rods 14. The projections define pockets or recesses 34 in which the guide rods 14 are located, preferably with some freedom of movement. The rods 14 can be secured to the head piece with the aid of cotter pins or the like. The head piece 15 is also provided with an integral central part 33 in which there is an aperture for receiving a pin forming the pivot joint 16. The pin is supported on lugs 35 projecting outwardly from the associated side plate 31 fixed to the conveyor 10. The head piece 15 has an open pocket or recess 36 adjacent the part 33. This pocket 36 extends through the entire thickness of the head piece 15 and is open towards the top and the bottom. The pocket 36 flares out in trumpet-like fashion at both the top and the bottom and shown by reference numerals 37, 38 in FIG. 4 so that coal dust and debris can pass therethrough. The pocket 36 is also shaped to snugly receive the end region 39 of the piston rod 27. The connection between the piston rod end region 39 and the head piece 15 is established by way of spherical bearing 40. More particularly, the end region 39 is formed with a cross-bore 40 having a curved internal profile 41, which flares and opens out in trumpet like fashion towards its ends. A pivot pin 43 provided with a convex peripheral surface 42 over its central zone locates in the bore 40 and enables the piston rod 27 to be flexibly movable in all directions within certain limits. The pin 43 has a head 45 which locates within a bore 45' in the head piece 15. The opposite end 46 of the pin 43 engages in a blind bore 46' in the head piece 15. The diameter of the end region 46 of the pin 43 is smaller than that of the head 45. This makes it easy to extract the pin 43 from the reception bores 45', 46' in the head piece 15 in a direction to the right of FIG. 4. The pin 43 is secured by means of a detachable locking member 47 which engages the head 45 and is secured to the head piece 15 by way of screws 48. When the screws 48 are released the pin 43 can be withdrawn. The head 45 and the bore 45' may be shaped, e.g. polygonal to lock together. The bores 45', 46' in the head piece 15 which receive the pin 43 are disposed so that the pin 43 takes an inclined disposition with its axis approximately perpendicular to that of the piston rod 27 of the associated piston and cylinder unit 26.

As shown in FIG. 4, the head piece 15 is also provided with a connecting device 49 located opposite the part 33. This device 49 supports a cover 50 which protects the guide rods 14. As shown particularly in FIG. 6, the guide rods 14 are deflected outwards as indicated by the reference numeral 14'. The bent end regions of the rod 14' are screened off by the cover 50. The cover 50 can be a composite component with flexible plate or mat 51 made of rubber or plastics or the like taking an approximately triangular shape. At the underside of the mat 51 there is a smaller metal plate 52 secured thereto with bolts or screws. As shown is FIGS. 4 and 6, a pivot joint 53 links the connecting device 49 to the plate 52 in a traction-resistant manner while allowing articulation.

The cylinder 29 of the piston cylinder unit 26 is formed with a part-spherical head 54 which engages in a complementary socket 55 provided at the upper end of the side plate 31 and the top plate 56 extending thereabove. The socket 55 is composed of three component parts that is to say, two components 57 and 58 which together form half the socket 55 and whcih are affixed to the plate 31 by means of screws or bolts 59. The line of separation between the components 57, 58 is designated by reference numeral 60 in FIG. 5. The socket 55 is completed by a half shell 61 which combines with the components 57, 58 to complete the spherical profile. The half shell 61 is detachably connected to the other components 57, 58 by means of screws 62 and in addition the half shell 61 is connected to the top plate 56 by way of screws or bolts 63. The half shell 61 serves as the final connecting piece by which the half shell formed by the components 57, 58 is closed off after the component part 54 is located. The socket 55 is essentially closed and only open from the underside so the entrance of dirt is inhibited. The provision of the multi-component socket 55 facilitates assembly and dis-assembly.

Figure 7:
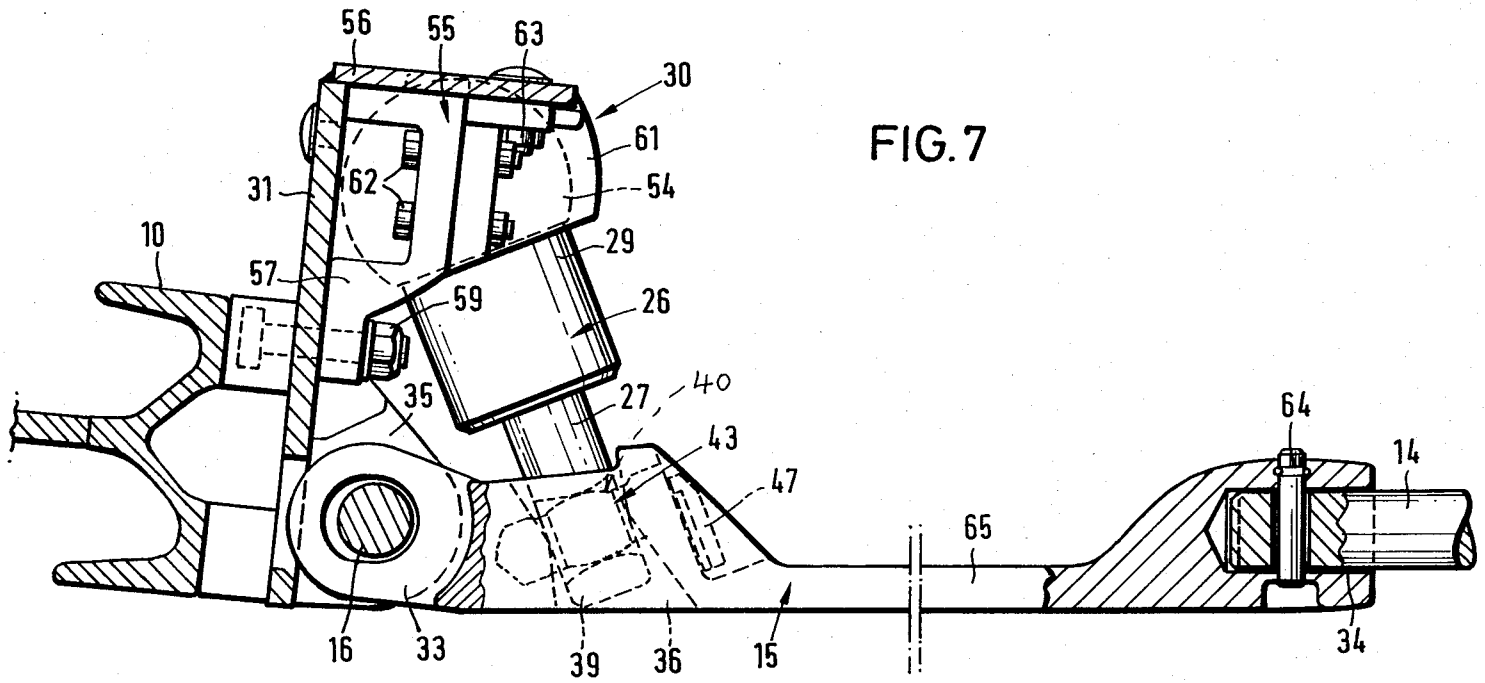
FIG. 7 is a view corresponding to FIG. 4 but showing a modified form of apparatus.

FIG. 7 depicts a modified embodiment where like reference numerals denote the like parts with respect to the other Figures of the drawings. This construction only differs from that shown in FIG. 4 in that the head piece 15 to which the guide bars 14 are connected by way of cotter pins 64 is prolonged and possesses a trough like central region 65 between the connections 34, 64 and the bearing 40.

We claim:

1. In apparatus for controlling the position of a mineral machine movable along a guide on one side of a conveyor and comprising bracket means on a side of the conveyor opposite said one side, at least one elongate rod guided for displacement on a roof support, connection means effecting pivotal connection between the conveyor and said rod and at least one inclined piston and cylinder unit connected between the connection means and the bracket means and operable to adjust the guide; the improvement wherein the piston and cylinder unit has its cylinder coupled to the bracket means with a ball-and-socket joint located above a pivot connection between the conveyor and the connection means, and the connection means has a pocket for receiving a lower region of the piston rod of said unit which is connected to the connection means with a lower pivot joint.

2. Apparatus according to claim 1 wherein the cylinder of said unit is provided with a part-spherical head forming the ball part of the ball-and-socket joint.

3. Apparatus according to claim 1 wherein the pocket extends through the connection means and is open in both upper and lower directions.

4. Apparatus according to claim 3 wherein the pocket is flared to open cut out in both upper and lower directions.

5. Apparatus according to claim 1 wherein the connection means has inclined bores communicating with the pocket for locating a pin forming part of the lower pivot joint.

6. Apparatus according to claim 1 wherein the lower pivot joint is a spherical bearing.

7. Apparatus according to claim 5 wherein the pin has a convex central region which locates in a shaped bore in the piston rod of the unit to form a spherical bearing.

8. Apparatus according to claim 5 wherein the pin extends through a cross-bore in the lower region of the unit and the pin is detachably fitted to the connection means.

9. Apparatus according to claim 8 wherein the pin has end regions of different size and is insertable and withdrawable from the location bores in the connection means in one direction.

10. Apparatus according to claim 1 wherein the socket of said ball-and-socket joint is of multi-part construction and can be separately assembled and dismantled.

11. Apparatus according to claim 10 wherein the parts of said socket comprise one half-shell and two further parts which collectively provide a second complementary half-shell.

12. Apparatus according to claim 1 wherein the connection means comprises at least one shaped head piece with a projection linked to the conveyor with said pivot connection and another region in which there is a bore for receiving said elongate rod.

13. Apparatus according to claim 1 wherein a cover is fitted to the connecting means to screen the elongate rod from the upper side.

14. Apparatus according to claim 1 wherein the connection means has the pocket closely adjacent the pivot connection with the conveyor and spaced from the elongate rod.

15. Apparatus according to claim 1 wherein the connection means has a trough-like profile between one region formed with the pocket and an opposite region linked to the elongate rod.

* * * * *